US005806785A

United States Patent [19]

Laplante et al.

[11] Patent Number: 5,806,785

[45] **Date of Patent: *Sep. 15, 1998**

[54] METHOD AND APPARATUS FOR PRODUCING A PRIMARY ROLL OF MATERIAL OR FOR DETERMINING AN AMOUNT OF MATERIAL AVAILABLE ON A PRIMARY ROLL

[75] Inventors: Benoît Laplante, Sherbrooke; Daniel Charland, St-Élie d'Orford, both of Canada

[73] Assignee: Recherche D.C.B.L. Inc./D.C.B.L. Research Inc., Bromptonville, Canada

[ * ] Notice: The term of this patent shall not extend beyond the expiration date of Pat. No. 5,402,353.

[21] Appl. No.: 888,498

[22] Filed: Jul. 7, 1997

Related U.S. Application Data

[63] Continuation of Ser. No. 532,599, Oct. 2, 1995, abandoned, which is a continuation-in-part of Ser. No. 69,942, May 28, 1993, Pat. No. 5,402,353.

[51] Int. Cl.[6] ..... B65H 18/08; B65H 26/06

[52] U.S. Cl. ..... 242/534; 242/534.2; 242/563.2; 242/912

[58] Field of Search ..... 242/534, 563, 242/912, 534.2, 563.2

[56] References Cited

U.S. PATENT DOCUMENTS

| | | | |
|---|---|---|---|
| 4,021,002 | 5/1977 | Meihofer | 242/563.2 |
| 4,535,950 | 8/1985 | Lisnyansky | 242/534.2 |
| 4,913,366 | 4/1990 | Andou | 242/563.2 |
| 5,402,353 | 3/1995 | Laplante et al. | 242/534.2 X |

FOREIGN PATENT DOCUMENTS

| | | |
|---|---|---|
| 0 171 345 | 2/1986 | European Pat. Off. . |
| 0 326 528 | 8/1989 | European Pat. Off. . |

*Primary Examiner*—John Q. Nguyen
*Attorney, Agent, or Firm*—Merchant, Gould, Smith, Edell, Welter & Schmidt

[57] ABSTRACT

The method is provided for producing a first primary roll (8) having a predetermined lateral surface defined by a diameter $D_f$, or for determining an amount of material available on a primary roll. The primary roll is made of material wound around a spindle (6). The material is used to produce smaller secondary rolls (12) of material. The method for producing the primary roll of material comprises steps of (a) calculating portion $S_f$ of the lateral surface, which is covered by the spindle; (b) calculating a portion $S_i$ of the lateral surface, which represents material needed to produce the smaller secondary rolls of material; (c) calculating a compression factor K1 which is derived from a compression rate K of a previous second primary roll used to produce previous secondary rolls with respect to the previous secondary rolls; (d) calculating $D_f$ where: $D_f=(4(S_f+(S_iK1)))/$ (e) winding up material around the spindle to produce the first primary roll until a diameter of the first primary roll reaches said diameter $D_f$; whereby loss of material is reduced by taking into account compression factor K1 which varies with respect to time. Apparatus to perform the method of producing the first primary roll (8) and for determining the amount of material available on a primary roll for producing smaller secondary rolls (12) is also provided.

18 Claims, 7 Drawing Sheets

METHOD AND APPARATUS FOR PRODUCING A PRIMARY ROLL OF MATERIAL OR FOR DETERMINING AN AMOUNT OF MATERIAL AVAILABLE ON A PRIMARY ROLL

This is a File Wrapper Continuation of application Ser. No. 08/532,599, filed Oct. 2, 1995, abandoned, which is a Continuation-In-Part of U.S. Pat. No. 5,402,353 issued Mar. 28, 1995.

FIELD OF THE INVENTION

The present invention is concerned with a method and an apparatus for producing a primary roll having a predetermined lateral surface defined by a Diameter $D_f$. The primary roll is made of material wound around a spindle. The material is used to produce smaller secondary rolls of material. More specifically, the present invention can be used in the paper industry. The present invention is also concerned with a method and apparatus for determining a value which is representative of an amount of material available on a primary roll for producing smaller secondary roles.

BACKGROUND OF THE INVENTION

Known in the art, there is the U.S. Pat. No. 4,519,039 of Bhupendra S. SURANA et al, granted on May 21, 1985 in which there is described a programmable controller including coil diameter calculator, strip speed derivation and inertia compensation. The controller is associated with a reel system for the generation in normalized digital form of a coil diameter of the reel instantaneously to allow initial calibration between successive coil winding and unwinding operations and automatic generation of a current reference for reel motor drive control.

Also known in the art, there is the U.S. Pat. No. 4,631,682 of David T. NG et al, granted on Dec. 23, 1986, in which there is described a control system which provides automatic control of winder deceleration and stopping to a preset sheet length, or preset roll diameter. The system utilizes a closed loop control of drive deceleration and automatic compensation for layers slabbed off following a sheetbreak.

Also known in the art, there is the U.S. Pat. No. 5,086,984 of Douglas E. TUREK et al, granted on Feb. 11, 1992, in which there is described a method of predicting final yarn package diameter during winding of yarn onto the package. The yarn is to be wound onto the package for a known period of time to obtain the final yarn package diameter. The method comprises the steps of: measuring the time for the package to grow to a known diameter, and predicting yarn package diameter using a predetermined correlation.

Also known in the art, there are the U.S. Pat. No. 4,913,366; 4,883,233; 4,811,915; 3,910,516; and 3,792,820 which describe different apparatuses and methods relating to the production of a roll of material.

In the paper industry, big primary roll are used to produce smaller secondary rolls which will be sold to clients. When successive primary rolls are used to produce secondary rolls, the amount of paper wound around each primary roll with identical diameter will not produce the same amount of material on secondary rolls because the compression rate of the paper wound around each primary roll with respect to material wound around their respective secondary rolls varies from time to time because the operating conditions of the machines used to produce secondary rolls from a primary roll are not exactly the same from time to time.

Accordingly, to solve this problem, it is known to wound around each primary roll an additional amount of paper to be sure that there will be enough paper for the secondary rolls that should be produced.

One problem with this is that a certain amount of paper is lost at the end of each primary roll when it is unrolled.

None of the above patents provides a method or an apparatus that takes into account the fact that the compression rate at which the paper is wound around a primary roll with respect to secondary rolls is not constant.

It is a main object of the present invention to provide methods and apparatus that take into account the fact that the compression rate at which the paper is wound around a roll of material by means of a manufacturing process is not constant.

It is an object of the present invention to provide a method and an apparatus for estimating with more precision the final diameter of the primary roll so that the loss of material when said primary roll is used to produce secondary rolls is reduced to minimum.

It is also an object of the present invention to provide a method and an apparatus for determining with more precision the amount of material available on a first primary roll for producing smaller secondary rolls.

SUMMARY OF THE INVENTION

According to the present invention, there is provided a method for producing a first primary roll having a predetermined lateral surface defined by a diameter $D_f$, said primary roll being made of material wound around a spindle, said material being used to produce smaller secondary rolls of material, said method comprising steps of:

(a) calculating a portion $S_f$ of said lateral surface, which is covered by said spindle;

(b) calculating a portion $S_i$ of said lateral surface, which represents material needed to produce said smaller secondary rolls of material;

(c) calculating a compression factor K1 which is derived from a compression rate K of a previous second primary roll used to produce previous secondary rolls with respect to said previous secondary rolls;

(d) calculating $D_f$ where:

$$D_f = \sqrt{(4(S_f + (S_i K1)))/\pi}$$

(e) winding up material around said spindle to produce said first primary roll until a diameter of said first primary roll reaches said diameter $D_f$;

whereby loss of material is reduced by taking into account said compression factor K1 which varies with respect to time.

Also according to the present invention, there is provided an apparatus for producing a first primary roll having a predetermined lateral surface defined by a lateral diameter $D_f$, said primary roll being made of material wound around a spindle, said material being used to produce smaller secondary rolls of material, said apparatus comprising:

is means for calculating a portion $S_f$ of said lateral surface, which is covered by said spindle;

means for calculating a portion $S_i$ of said lateral surface, which represents material needed to produce said smaller secondary rolls of material;

means for calculating a compression factor K1 which is derived from a compression rate K of a previous second primary roll used to produce previous secondary rolls with respect to said previous secondary rolls;

means for calculating $D_f$ where:

$$D_f = \sqrt{(4(S_f + (S_i K1)))/\pi}$$

means for winding up material around said spindle to produce said first primary roll until a diameter of said first primary roll reaches said diameter $D_f$;

whereby loss of material is reduced by taking into account said compression factor K1 which varies with respect to time.

Also, according to the present invention, there is provided a method for determining a value $S_d$ which is representative of an amount of material available on a first primary roll for producing first smaller secondary rolls, said first primary roll being previously produced by a given manufacturing process, having a diameter value $D_f$ and comprising a spindle having a diameter value $D_{sf}$, said method comprising steps of:

(a) calculating a compression factor $K_1$ which is derived from a ratio R of a second primary roll used to produce second smaller secondary rolls with respect to said second smaller secondary rolls, said second primary roll being also previously produced by said manufacturing process;

(b) determining a value X which is representative of an amount of material wound around the spindle of said first primary roll by means of said diameter values $D_f$ and $D_{sf}$;

(c) determining a value $S_p$ which is representative of an unusable amount of material on said first primary roll, said unusable amount of material being included in said amount of material available on said first primary roll; and (d) determining said value $S_d$ as a function of $[(X-S_p)/K_1]$.

Also, according to the present invention, there is provided a method for producing first smaller secondary rolls of material with given diameter values from an amount of material available on a first primary roll, said amount of material being represented by a value $S_d$, said first primary roll being previously produced by a given manufacturing process, having a diameter value $D_f$ and comprising a spindle having a diameter value $D_{sf}$, said method comprising steps of:

(a) calculating a compression factor $K_1$ which is derived from a ratio R of a second primary roll used to produce second smaller secondary rolls with respect to said second smaller secondary rolls, said second primary roll being also previously produced by said manufacturing process;

(b) determining a value X which is representative of an amount of material wound around the spindle of said first primary roll by means of said diameter values $D_f$ and $D_{sf}$;

(c) determining a value $S_p$ which is representative of an unusable amount of material on said first primary roll, said unusable amount of material being included in said amount of material available on said first primary roll;

(d) determining said value $S_d$ as a function of $[(X-S_p)$;

(e) calculating a value $S_{bstot}$ which is representative of an amount of material which is needed to produce said first smaller secondary rolls, said value $S_{bstot}$ being calculated by taking into account said compression factor K1;

(f) verifying whether said amount of material available on said first primary roll is sufficient to produce said first smaller secondary rolls by comparing said value $S_d$ to said value $S_{bstot}$, and either producing said first secondary rolls if said amount of material available is sufficient, or else going to step (g); and (g) verifying whether said amount of material available on said first primary roll is sufficient to produce said first smaller secondary rolls where one or more of said first smaller secondary rolls have a reduced diameter value which is determined by taking into account $K_1$ and is equal to or greater than a predetermined acceptable reduced diameter value, and either producing said first smaller secondary rolls wherein at least one of said first smaller secondary rolls has said reduced diameter value if said amount of material available is sufficient, or else producing only the ones of the first smaller secondary rolls which can be completely produced with said given diameter values from said amount of material available on said first primary roll.

According to the present invention, there is also provided an apparatus for determining a value $S_d$ which is representative of an amount of material available on a first primary roll for producing first smaller secondary rolls, said first primary roll being previously produced by a given manufacturing process, having a diameter value $D_f$ and comprising a spindle having a diameter value $D_{sf}$, said apparatus comprising:

means for calculating a compression factor $K_1$ which is derived from a ratio R of a second primary roll used to produce second smaller secondary rolls with respect to said second smaller secondary rolls, said second primary roll being also previously produced by said manufacturing process;

means for determining a value X which is representative of an amount of material wound around the spindle of said first primary roll by means of said diameter values $D_f$ and $D_{sf}$; and means for determining said value $S_d$ as a function of $[(X-S_p)/K_1]$, where $S_p$ is representative of an unusable amount of material on said first primary roll.

According to the present invention, there is also provided an apparatus for producing first smaller secondary rolls of material with given diameter values from an amount of material available on a first primary roll, said amount of material being represented by a value $S_d$, said first primary roll being previously produced by a given manufacturing process, having a diameter value $D_f$ and comprising a spindle having a diameter value $D_{sf}$, said apparatus comprising:

means for calculating a compression factor $K_1$ which is derived from a ratio R of a second primary roll used to produce second smaller secondary rolls with respect to said second smaller secondary rolls, said second primary roll being also previously produced by said manufacturing process;

means for determining a value X which is representative of an amount of material wound around the spindle of said first primary roll by means of said diameter values $D_f$ and $D_{sf}$;

means for determining said value $S_d$ as a function of $(X-S_p)$ where $S_p$ is representative of an unusable amount of material on said first primary roll;

means for calculating a value $S_{bstot}$ which is representative of an amount of material which is needed to produce said first smaller secondary rolls, said value $S_{bstot}$ being calculated by taking into account said compression factor K1;

means for verifying whether said amount of material available on said first primary roll is sufficient to produce said first smaller secondary rolls by comparing said value $S_d$ to said value $S_{bstot}$;

means for verifying whether said amount of material available on said first primary roll is sufficient to produce said first smaller secondary rolls where one or more of said first smaller secondary rolls have a reduced diameter value which is determined by taking into account $K_1$ and is equal to or greater than a predetermined acceptable reduced diameter value;

means for producing said first smaller secondary rolls wherein at least one of said first smaller secondary rolls has said reduced diameter value if said amount of material available is sufficient; and means for producing only the ones of the first smaller secondary rolls which can be completely produced with said given diameter values from said amount of material available on said first primary roll if said amount of material is not sufficient.

The objects, advantages and other features of the present invention will become more apparent upon reading of the following non restrictive description of a preferred embodiment thereof given for purpose of exemplification only with reference to the accompanying drawings.

DETAILED DESCRIPTION OF THE DRAWINGS

Figure 1:
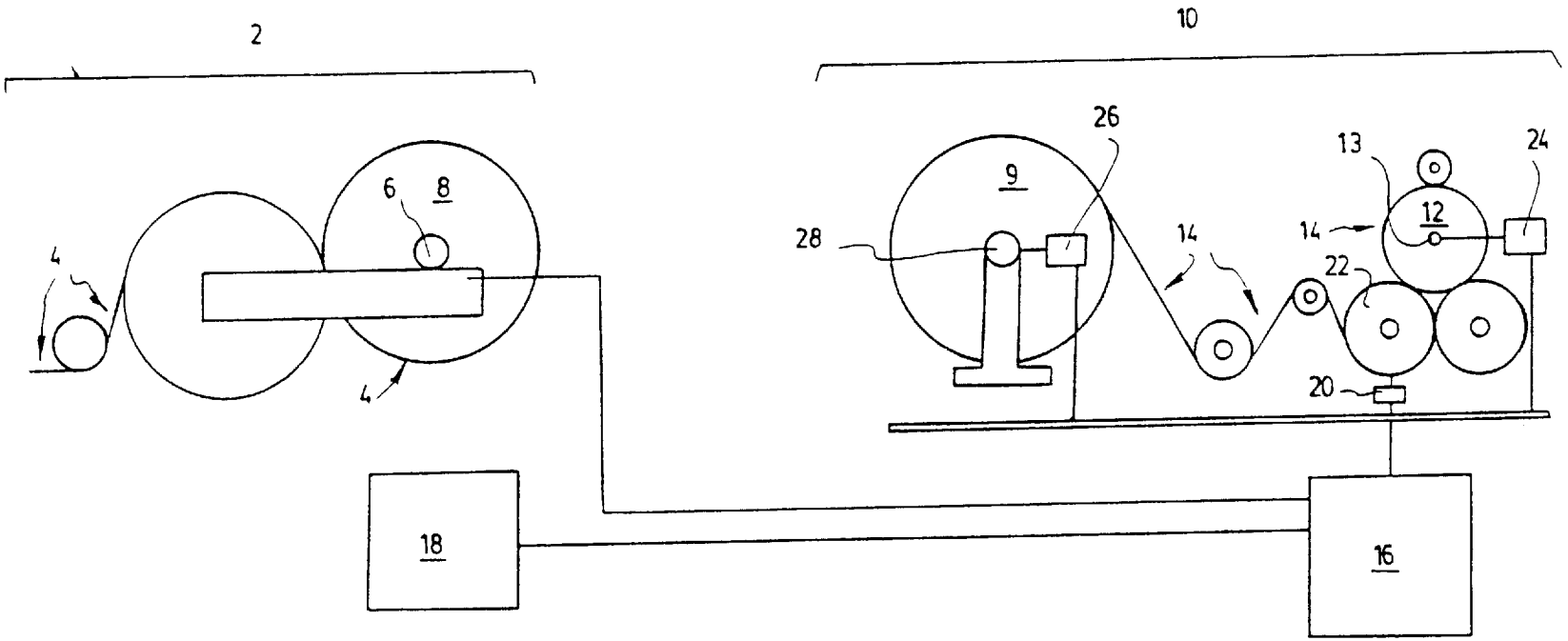
FIG. 1 is a schematic diagram illustrating schematically how a primary roll is produced, and how a secondary roll is produced from a primary roll.

Referring now to FIG. 1, there is shown working station 2 where a sheet of paper 4 is wound around a metal spindle 6 to produce primary roll 8. Also, there is shown working station 10 where primary roll 9 is unrolled to produce secondary roll 12. From one primary roll 9, several smaller secondary rolls 12 are produced to be delivered to clients. The final diameter D of the primary roll 9 depends directly on the final diameter of the secondary rolls 12 to be delivered to the clients.

It has been found that for an identical combination of secondary rolls to be produced from a primary roll, the diameter of successive primary rolls will not be the same. This is caused by the variation of volumetric reduction of the paper sheet 14 due to mechanical work at the working station 10 when the paper sheet 14 is unrolled from the primary roll 9 and wound around spindle 13 to produce secondary roll 12.

Also, when primary roll 8 is produced, paper sheet 4 can be torn or a portion of paper sheet 4 can have an unacceptable quality. All these factors have to be taken into consideration so that the primary roll 8 has a sufficient amount of paper to produce predetermined secondary rolls to be delivered to clients.

The working stations 2 and 10 are provided with several equipments which comprise a computer 16, a terminal 18 disposed nearby an operator, an optical detector 20 for detecting the number of turns made by drum 22, an optical detector 24 for detecting the number of turns made by secondary roll 12, and another optical detector 26 for detecting the number of turns made by spindle 28.

Figure 2:
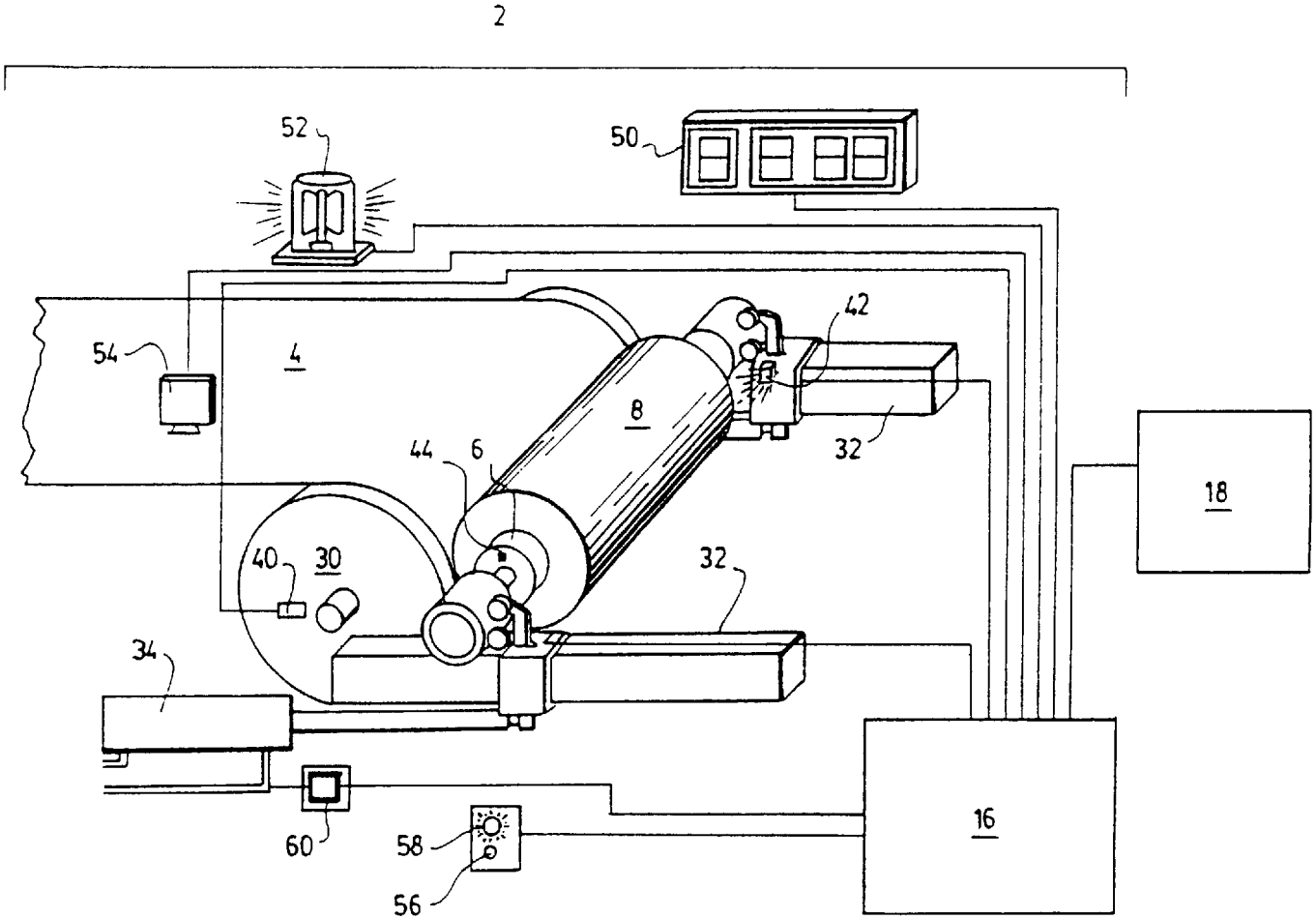
FIG. 2 is a schematic diagram illustrating with more details a working station shown in FIG. 1.

Referring now to FIG. 2, there is shown with more details working station 2. Paper sheet 4 coming from a paper machine (not shown) is moved around drum 30 to be wound around spindle 6. Spindle 6 is supported by means of rails 32. A constant pressure is applied on each side of the spindle 6 of primary roll 8 by means of cylinders 34. Only one cylinder 34 is shown in this figure, but it is understood that each side of spindle 6 is subjected to a pressure applied by a cylinder. Paper sheet 4 is wound around spindle 6 until the diameter of primary roll 8 reaches a predetermined value.

The present system is capable of measuring the diameter of primary roll 8 in real time. Several known methods can be used for measuring this diameter. According to working station 2, shown in FIG. 2, the diameter of primary roll 8 is calculated from pulses received from detector 40 and detectors 42. Only one detector 42 is shown in FIG. 2, but the other side of spindle 6 is also provided with a detector. Detector 40 generates a pulse during each turn of drum 30 and detectors 42 generate a pulse during each turn of spindle 6. A reflecting sticker 44 is stuck at each end of spindle 6 and is used to reflect an optical ray generated by detectors 42. When one detector 42 receives a reflection from its corresponding sticker 44, it generates instantaneously an electric pulse which is sent to a computer 16 provided with an operating software. Only one of detectors 42 is used at the time. The second detector 42 is used as a back-up. Computer 16 measures with precision the period of time between pulses generated by detectors 40 and 42 and calculates in real time the radius D of primary roll 8.

$D=[(T_f D_e)/T_e)$, where D is the diameter of primary roll 8, $T_f$ is the period of time measured between two pulses generated by detector 42, $D_e$ is the diameter of drum 30, and $T_e$ is the period of time measured between two pulses generated by detector 40.

Also shown in this FIG. 2, there are a display 50 showing the period of time remaining before the actual diameter of primary roll 8 reaches a predetermined diameter, an alarm 52, a detector 54 detecting when paper sheet 4 is torn up, a button 56 by which the operator can also indicate to computer 16 that paper sheet 4 is torn up, another button 58 by which the operator can indicate to computer 16 that quality of paper is not acceptable, and a pressure detector 60 by which computer is informed of pressure applied by cylinders 34.

Referring now to FIGS. 1 and 2, it is understood that diameters of secondary roll 12 and primary roll 9 of working station 10 can be determined in real time by optical means similar to the ones shown in FIG. 2.

The apparatus for producing first primary roll 8 having a predetermined lateral surface defined by lateral diameter $D_f$ is shown in FIGS. 1 and 2. The primary roll 8 is made of material wound around spindle 6. The material is used to produce smaller secondary rolls 12 of material. The apparatus comprises means for calculating a portion $S_f$ of the lateral surface of primary roll, which is covered by its spindle. This means for calculating is performed by computer 16 and the calculation is done with respect to parameters entered by the operator by means of terminal 18.

The apparatus also comprises means for calculating a portion $S_p$ of the lateral surface, which represents remaining unusable material wound around the spindle of primary roll. Again, this means for calculating is performed by computer 16 with respect to parameters entered by the operator.

The apparatus also comprises means for calculating a portion $S_a$ of the lateral surface, which represents an error margin determined by the operator. Again, this error margin corresponds to parameters entered in computer 16 by the operator.

The apparatus also comprises means for calculating a portion $S_i$ of the lateral surface which represents material needed to produce several smaller secondary rolls of material. This portion $S_i$ is calculated from parameters entered by the operator in computer 16.

Also, the apparatus comprises means for calculating a compression factor K1 which is derived from a compression rate K where K=[(sum of lateral surfaces of material of previous primary roll 9 used to produce previous secondary rolls 12)/(sum of lateral surfaces of material of said previous secondary rolls 12)]. This means for calculating is performed by computer 16 by means of equipments at working station 10.

The apparatus also comprises means for calculating $D_f$ where:

$$D_f = \sqrt{(4(S_f + S_p + S_a + (S_i K1)))/\pi}$$

This means for calculating $D_f$ is performed by computer 16.

The apparatus also comprises means for winding up material around spindle 6 to produce primary roll 8 until its diameter reaches diameter $D_f$. This means for winding up is situated at working station 2. By means of the present apparatus, the loss of material is reduced by taking into account compression factor K1 which varies with respect to time.

Also, the apparatus preferably comprises means for calculating at least another compression rate K of at least another primary roll with respect to previous secondary rolls, and means for calculating an average value of the compression rates K so that the compression factor K1 be derived from the average value. Again, the above-mentioned means for calculating are performed by the computer 16 when successive primary rolls 9 are unrolled to produce secondary rolls 12 at working station 10.

In operation, first, when no compression rate K has been calculated, the operator determines, in an empirical manner, the diameter of primary roll 8 in function of the number and the size of secondary rolls to be delivered to clients. He also adds a security margin. Once primary roll 8 has a diameter which reaches the predetermined diameter, the operator transfers primary roll 8 from working station 2 to working station 10 where said primary roll becomes primary roll 9.

Then, paper sheet 14 is engaged around metal spindle 13 so that primary roll 9 be unrolled to produce a first secondary roll 12. When first secondary roll 12 reaches a desired diameter, it is removed from working station 10, and paper sheet 14 is disposed around another spindle 13 to produce another secondary roll 12. This operation is repeated until primary roll 9 has not enough paper to produce another secondary roll 12. Then, the remaining amount of paper around spindle 28 is lost.

But, as primary roll 9 is unrolled to produce secondary rolls, a compression factor K1 is derived from a compression rate K where K [(sum of lateral surfaces of material of primary roll 9 used to produce secondary rolls 12)/(sum of lateral surfaces of material of secondary rolls 12)]. The value of the compression factor K1 can be equal to the compression rate K or it can correspond to an average value of compression rates K calculated during successive unwinding of primary rolls 9.

Figure 3:
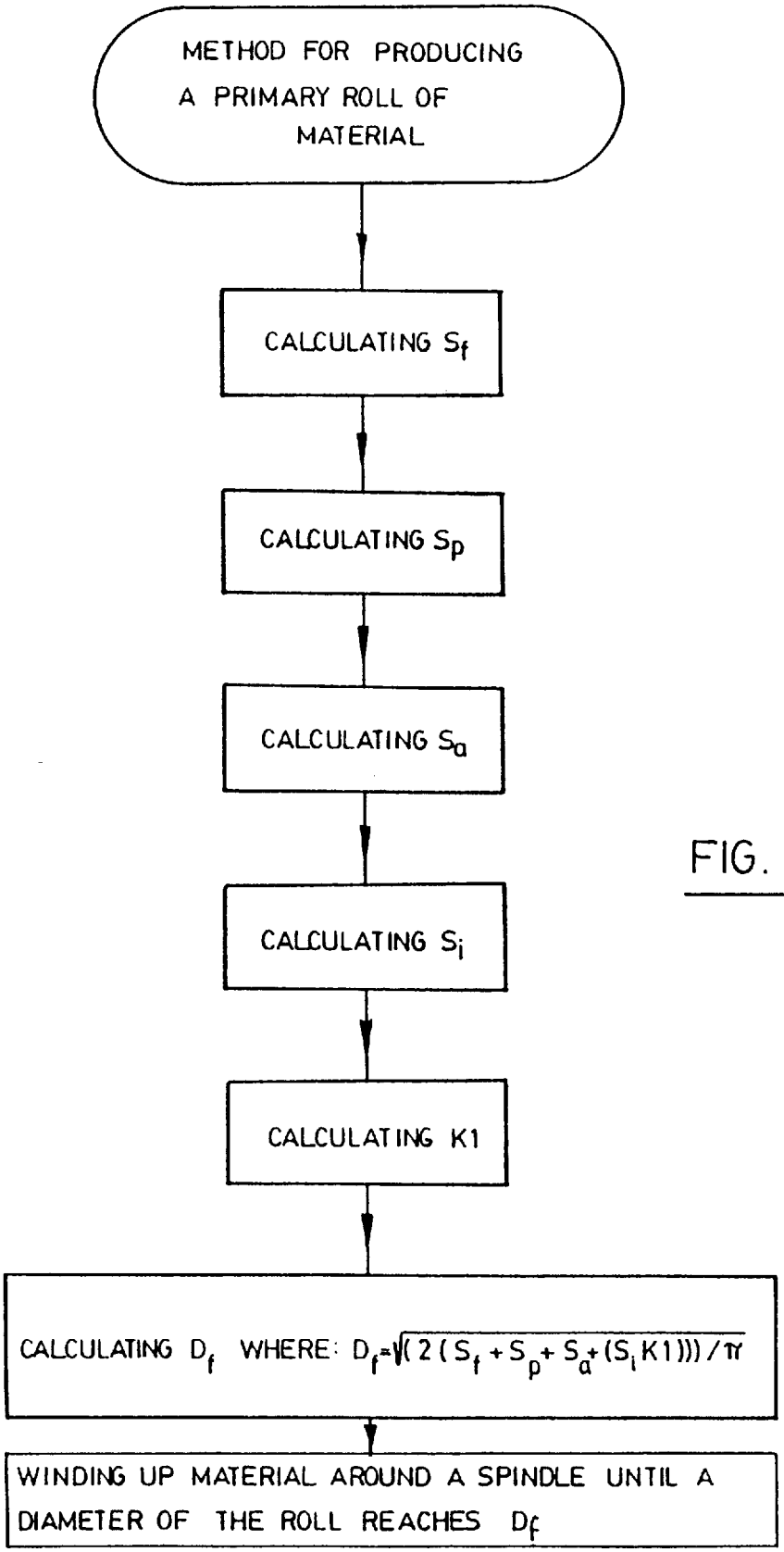
FIG. 3 is a flow chart diagram illustrating the method for producing a primary roll in accordance with the present invention.

When a value of compression factor K1 has been obtained, then it is possible to perform the method according to the present invention for producing the next primary roll 8 of material according to the flow chart shown in FIG. 3. The method is for producing a primary roll 8 having a predetermined lateral surface defined by a diameter $D_f$. The material will be used to produce smaller secondary rolls 12 of material. The method comprises steps of calculating a portion $S_f$ of the lateral surface, which is covered by spindle 6; calculating a portion $S_p$ of the lateral surface, which represent remaining unusable material wound around spindle 6, such portion $S_p$ being determined by the operator; calculating a portion $S_a$ of the lateral surface, which represents an error margin determined by the operator; calculating a portion $S_i$ of the lateral surface, which represents material needed to produce smaller secondary rolls 12 of material; calculating the compression factor K1 which is derived from the compression factor K defined earlier; calculating $$D_f = \sqrt{(4(S_f + S_p + S_a + (S_i K1)))/\pi}$$

and winding up material around spindle 6 to produce first primary roll 8 until its diameter reaches diameter $D_f$, whereby loss of material is reduced by taking into account pressure factor K1 which varies with respect to time. The step of calculating $D_f$ may further comprise a step of calculating a length of material $L_{BP}$ which is necessary to produce the first primary roll having the diameter value $D_f$, the length of material $L_{BP}$ is calculated by means of the following equation:

$$L_{BP}=[\pi*(D^2_f-D^2_{sf})/(4*E_{BP})]$$

where $D_{sf}$ is a diameter value of the spindle, and $E_{BP}$ is an estimated thickness value of the material.

The compression factor K1 is calculated in real time each time that primary roll 9 is unrolled at working station 10. The measure of diameter of primary roll 9 and secondary roll 12 can be done by means of different optical means, mechanical means and electrical means. We will now describe one manner to determine the diameters of rolls 9 and 12. By means of pulse generator 20 having a resolution of several pulses by turn, attached to drum 22, and by means of another pulse generator 26 having a resolution of one pulse by turn, attached to spindle 28, it is possible to calculate in real time the diameter of primary roll 9 at working station 10.

Computer 16 calculates diameter $D_p$ of primary roll 9 by means of the following equation:

$$D_p=[(PPT_1D_t)/RT_1)$$

where $RT_1$ is the resolution of pulse generator 20 in pulses by turn, $D_t$ is the diameter of drum 22, $PPT_1$ is the number of pulses produced by pulse generator 20 for each pulse generated by pulse generator 26. Calculation of the diameter of secondary roll 12 is done in a similar manner by using pulse generators 20 and 24. When secondary roll 12 has been completed, computer 16 calculates lateral surface of rolls 9 and 12 by means of the following equations:

$$S_p=[((\pi(D_p \text{ at the beginning})^2)/4)-((\pi(D_p \text{ at the stop})^2)/4)]$$

$$S_s=[((\pi(D_s \text{ at the stop})^2)/4)-((\pi(D_s \text{ at the beginning})^2)/4)]$$

where $S_p$ is the lateral surface of material of primary roll 9, used for producing secondary roll 12; $D_p$ are diameters at the beginning and at the stop of primary roll 9 when winding of secondary roll 12 begins and ends; $S_s$ is the lateral surface of material of secondary roll 12; and $D_s$ are diameters at the beginning and at the stop of secondary roll 12.

If three secondary rolls are produced from one primary roll 9, then:

$$K1=K=[(S_{p1}+S_{p2}+S_{p3})/(S_{s1}+S_{s2}+S_{s3})].$$

It has to be noted that only the lateral surfaces transferred from primary roll 9 to secondary rolls 12 are used in the above-mentioned calculation. Thus, $S_{p1}$ is the lateral surface removed from primary roll 9 during the winding of secondary roll 12, which has been used for producing $S_{s1}$ of secondary roll 12.

The number and the size of secondary rolls to be produced from primary roll 9 are entered by the operator in computer 16 by means of terminal 18. Then, it is possible to calculate in real time $D_f$ of the next primary roll 8 at working station 2 by taking into consideration the compression factor K1 calculated by computer 16. The calculation of $D_f$ can be done according to the equation mentioned earlier.

In order to better understand the method according to the present invention, we will now describe an example with possible parameters. First, we have to calculate a first value of K1 when primary roll 9 is unrolled to produce smaller secondary rolls 12. In this example, four secondary rolls are produced. Each of the secondary rolls has a spindle having a diameter of 0.100 m, and has a final diameter of 1.00 m.

For the production of the first secondary roll, $D_{s1}$ and $D_{p1}$ are 0.100 m and 2.117 m at the beginning, and 1.00 m and 1.864 m at the stop. Then, computer 16 calculates $S_{s1}$ which is:

$$[((\pi(1.000 \text{ m})^2)/4)-((\pi(0.1000 \text{ m})^2)/4)]=0.7775 \text{ m}^2.$$

We also calculate $S_{p1}$ which is:

$$[((\pi(2.117 \text{ m})^2)/4)-((\pi(1.862 \text{ m})^2)/4)]=0.7969 \text{ m}^2.$$

For the production of the second secondary roll, $D_{s2}$ and $D_{p2}$ are 0.100 m and 1.862 m at the beginning and 1.00 m and 1.566 m at the stop. Then, we calculate $S_{s2}$ which is:

$$[((\pi(1.000 \text{ m})^2)/4)-((\pi(0.100 \text{ m})^2)/4)]=0.7775 \text{ m}^2.$$

We can also calculate $S_{p2}$ which is:

$$[((\pi(1.862 \text{ m})^2)/4)-((\pi(1.566 \text{ m})^2)/4)]=0.7969 \text{ m}^2.$$

For the production of the third secondary roll, $D_{s3}$ and $D_{p3}$ are 0.100 m and 1.566 m at the beginning, and 1.00 m and 1.199 m at the stop. We can now calculate $S_{s3}$ and $S_{p3}$ with the equations mentioned above and we found that $S_{s3}$= 0.7775 $m^2$ and $S_{p3}$=0.7969 $m^2$.

For the production of the fourth and last secondary roll, $D_{s4}$ and $D_{p4}$ are 0.100 m and 1.199 m at the beginning, and are 1.000 m and 0.650 m at the stop. By using the equations mentioned above, we found that $S_{s4}$=0.7775 $m^2$ and $S_{p4}$= 0.7969 $m^2$.

We now calculate K which is in the present case K1. K=[(0.7969 $m^2$+0.7969 $m^2$+0.7969 $m^2$+0.7969 $m^2$)/(0.7775 $m^2$+0.7775 $m^2$+0.7775 $m^2$+0.7775 $m^2$)]=1.025.

We are now ready to evaluate the final diameter $D_f$ of the next primary roll 8. First, the operator entered by means of the terminal 18 a new order for producing a primary roll 8 at the working station 2, which will have enough paper to produce three smaller secondary rolls, each of the secondary rolls having a spindle diameter of 0.100 m and a final diameter of 1.2 m.

The spindle 6 mounted at the working station 2 has around it useless paper having a thickness of 0.025 m. Accordingly, a quantity of paper equivalent to this useless paper has to be added to obtain enough paper for producing the three secondary rolls.

The following parameters are entered by the operator at the terminal: diameter of the spindle 6 of primary roll 8, which is 0.600 m; thickness of the useless paper present around the spindle 6, which is 0.025 m; final diameters of three secondary rolls to be produced from this primary roll, each final diameter of the secondary rolls being 1.200 m, diameter spindle of secondary rolls, which is 0.100 m; and a security margin determined by the operator, which is 0.020 m. Also, it has to be noted that the value of K1 is in the memory of the computer and has a value of 1.025.

First, we calculate $S_f$ which is:

$$[(\pi(\text{diameter of the spindle})^2)/4],$$

$$[(\pi(0.600)^2)/4]=0.283 \text{ m}^2.$$

Then, we calculate $S_p$ which represents the useless paper having a thickness of 0.025 m from the surface of the spindle. It is known that the spindle diameter is 0.600 m, and the external diameter of the paper loss is:

$$[(0.025 \text{ m}\times 2)+0.600 \text{ m}]=0.650 \text{ m}.$$

$s_p$ can now be calculated, which is:

$$[((\pi(\text{external diameter of useless paper})^2)/4)-((\pi(\text{internal diameter of useless paper})^2)/4)],$$

$$[((\pi(0.650 \text{ m})^2)/4)-((\pi(0.600 \text{ m})^2)/4)]=0.049 \text{ m}^2.$$

We now calculate the surface of paper relating to the error margin. As the error margin is 0.010 m, we can evaluate that the internal diameter of the error margin is 0.0650 m and its external diameter is 0.670 m. The surface relating to the error margin S is:

$$[((\pi(\text{external diameter of the paper relating to the error margin})^2)/4)-((\pi(\text{internal diameter of the paper relating to the error margin})^2)/4)],$$

$$[((\pi(0.670 \text{ m})^2)/4)-((\pi(0.650 \text{ m})^2)/4)]=0.021 \text{ m}^2.$$

We have now to calculate the surface $S_i$ of paper relating to the production of three secondary rolls, each of the secondary rolls having a final diameter of 1.200 m and a spindle diameter of 0.100 m. The surface $S_{bs}$ of one secondary roll is:

$$[((\pi(\text{external diameter of the roll})^2)/4)-((\pi(\text{internal diameter of the roll})^2)/4)],$$

$$[((\pi(1.200 \text{ m})^2)/4)-((\pi(0.100 \text{ m})^2)/4)]=1.123 \text{ m}^2.$$

Consequently, the surface $S_i$ of three secondary rolls is $(1.123\ m^2 \times 3) = 3.369\ m^2$.

We now calculate the final diameter of the next primary roll, which is:

$$D_f = \sqrt{(4(S_f + S_a + S_p + (S_i K1)))/\pi}$$

$$D_f = \sqrt{(4(0.283\ m^2 + 0.021\ m^2 + 0.049\ m^2 + (3.369\ m^2 \times 1.025)))/\pi}$$

$$D_f = 2.201\ m$$

Computer 16 will now monitor in real time the winding of the next primary roll 8 at working station 2 and will stop the winding when the diameter of primary roll 8 will reach the value of $D_f$.

As mentioned hereinbefore, the present invention also comprises an apparatus for determining a value $S_d$ which is representative of an amount of material available on a first primary roll for producing first smaller secondary rolls. This first primary roll is previously produced by a given manufacturing process, has a diameter value $D_f$ and comprises a spindle which has a diameter value $D_{sf}$. This apparatus is also shown in FIGS. 1 and 2 and described hereinabove. As aforesaid, the means for calculating the compression factor $K_1$, which is derived from a ratio R of a second primary roll used to produce smaller secondary rolls with respect to said second smaller secondary rolls, is performed by the computer 16 by means of equipments at working station 10. Moreover, this apparatus further comprises means for determining a value X which is representative of an amount of material wound around the spindle of the first primary roll by means of the diameter values $D_f$ and $D_{sf}$. The values of the diameters $D_f$ and $D_{sf}$ can be determined by the aforesaid optical means. This means for determining the value X is performed by the computer 16 and is done with respect to parameters entered by the operator by means of terminal 18.

The apparatus also comprises means for determining the value $S_d$ as a function of $[(X-S_p)/K_1]$ where $S_p$ is representative of an unusable amount of material on the first primary roll. This means for determining $S_d$ is performed by the computer 16 with respect to the parameters entered to the computer by the operator.

The apparatus further comprises means for calculating a value $S_{bstot}$ which is representative of an amount of material needed to produce the first smaller secondary rolls. This means for calculating is performed by the computer 16, again with respect to the parameters entered by the operator. Furthermore, the apparatus comprises means for verifying whether the amount of material available on the first primary roll is sufficient to produce the first smaller secondary rolls by comparing the value $S_d$ to the value $S_{bstot}$, and means for verifying whether the amount of material available on the first primary roll is sufficient to produce the first smaller secondary rolls where one or more of the first smaller secondary rolls have a reduced diameter which is equal to or greater than a predetermined acceptable reduced diameter value. In both cases, the apparatus can produce the first secondary rolls with the equipments at working station 10 if the amount of material available is sufficient. The means for verifying are performed by the computer 16.

Also, the apparatus comprises means for comparing a value $D_{bsres}$ which is representative of an amount of material which is left after producing the first smaller secondary rolls to a predetermined limit value.

In operation, the apparatus described hereinabove performs the following method for determining a value $S_d$ which is representative of an amount of material available on a first primary roll for producing first smaller secondary rolls. The method comprises steps of calculating $K_1$; determining a value X which is representative of an amount of material wound around the spindle of the first primary roll by means of the diameter values $D_f$ and $D_{sf}$; and determining the value $S_d$ as a function of $[(X-S_p)/K_1]$, where $S_p$ is representative of an unusable amount of material on the first primary roll.

This method may comprise further steps for producing first smaller secondary rolls of material with given diameter values from the amount of material available on the first primary roll. The additional steps comprise steps of calculating a value $S_{bstot}$ which is representative of an amount of material needed to produce the first smaller secondary rolls; verifying whether the amount of material available on the first primary roll is sufficient to produce the first smaller secondary rolls by comparing the value $S_d$ to the value $S_{bstot}$, and either producing the first secondary rolls if the amount of material available is sufficient, or else verifying whether the amount of material available on the first primary roll is sufficient to produce the first smaller secondary rolls where one or more of the first smaller secondary rolls have a reduced diameter which is equal to or greater than a predetermined acceptable reduced diameter value.

If the latter test is positive, then the method further comprises the steps of producing the first smaller secondary rolls wherein at least one of the first smaller secondary rolls has the reduced diameter value if the amount of material available is sufficient, or else producing only the ones of the first smaller secondary rolls which can be completely produced with the given diameter values from the amount of material available on the first primary roll.

Also, the method may further comprise steps of comparing a value $D_{bsres}$ which is representative of the amount of material which is left after producing the ones of the first smaller secondary rolls with the given diameter values to a predetermined limit value, and either disposing the amount of material which is left if the value $D_{bsres}$ is smaller than the predetermined limit value, or recuperating the amount of material which is left by adding the amount of material which is left to a next primary roll.

The above-mentioned value X is determined by means of the following equation:

$$X = [(\pi * D^2_f)/4 - (\pi * D^2_{sf})/4].$$

The above-mentioned value $S_{bstot}$ is calculated by means of the following equation:

$$S_{bstot} = S_{bs(1)} + \ldots + S_{bs(n)}$$

where $S_{bs(1)} + \ldots + S_{bs(n)}$ is a sum of lateral surfaces of material of the first smaller secondary rolls which are n in number, each of the lateral surfaces of the first smaller secondary rolls are calculated by means of the following equation;

$$S_{bs(x)} = [\pi(D^2_{bs(x)} - D^2_{bss(x)})/4]$$

where $D_{bs(x)}$ is a diameter value of the corresponding smaller secondary roll which is numbered by x, and $D_{bss(x)}$ is a diameter value of a spindle thereof.

In an alternative embodiment, there is also provided an apparatus for producing first smaller secondary rolls of material with given diameter values from an amount of material available on a first primary roll. This apparatus, according to the alternative embodiment, is similar to the apparatus described hereinbefore except that it comprises means for determining the value $S_d$ as a function of $(X-S_p)$ and means for calculating value $S_{bstot}$ by means of the following equation:

$$S_{bstot}=S_{bs(1)}+\ldots+S_{bs(n)}$$

where $S_{bs(1)}+\ldots+S_{bs(n)}$ is a sum of lateral surfaces of material of the first smaller secondary rolls which are n in number, each of the lateral surfaces of the first smaller secondary rolls being calculated by means of the following equation:

$$S_{bs(x)}=[\pi(D^2_{bs(x)}-D^2_{bss(x)})/4]*K_1$$

where $D_{bs(x)}$ is a diameter value of the corresponding smaller secondary roll which is numbered by x and $D_{bss(x)}$ is a diameter value of a spindle thereof. These means for determining $S_d$ and means for determining $S_{bstot}$ are performed by the computer 16.

In operation, the apparatus according to the alternative embodiment performs a method which comprises steps of calculating the aforesaid compression factor $K_1$ which is derived from the ratio R of the second primary roll used to produce second smaller secondary rolls with respect to said second smaller secondary rolls, the second primary roll being also previously produced by the manufacturing process; determining a value X which is representative of an amount of material wound around the spindle of the first primary roll by means of the diameter values $D_f$ and $D_{sf}$; determining a value $S_p$ which is representative of an unusable amount of material on the first primary roll, the unusable amount of material being included in the amount of material available on the first primary roll; determining the value $S_d$ as a function of $(X-S_p)$; calculating a value $S_{bstot}$ which is representative of an amount of material which is needed to produce the first smaller secondary rolls, the value $S_{bstot}$ being calculated by taking into account the compression factor K1; verifying whether the amount of material available on the first primary roll is sufficient to produce the first smaller secondary rolls by comparing the value $S_d$ to the value $S_{bstot}$, and either producing the first secondary rolls if the amount of material available is sufficient, or else verifying whether the amount of material available on the first primary roll is sufficient to produce the first smaller secondary rolls where one or more of the first smaller secondary rolls have a reduced diameter value which is determined by taking into account $K_1$ and is equal to or greater than a predetermined acceptable reduced diameter value.

If the latter test is positive, the method further comprises the steps of producing the first smaller secondary rolls wherein at least one of the first smaller secondary rolls has the reduced diameter value if the amount of material available is sufficient, or else producing only the ones of the first smaller secondary rolls which can be completely produced with the given diameter values from the amount of material available on the first primary roll.

The method may further comprise step of comparing a value $D_{bsres}$ which is representative of the amount of material which is left after producing the ones of the first smaller secondary rolls with the given diameter values to a predetermined limit value, and either disposing the amount of material which is left if the value $D_{bsres}$ is smaller than the predetermined limit value, or recuperating the amount of material which is left by adding the amount of material which is left to a next primary roll.

The value $S_{bstot}$ according to the method of the alternative embodiment, is determined by means of the following equation:

$$S_{bstot}=S_{bs(1)}+\ldots+S_{bs(n)}$$

where $S_{bs(1)}+\ldots+S_{bs(n)}$ is a sum of lateral surfaces of material of the first smaller secondary rolls which are n in number, each of the lateral surfaces of the first smaller secondary rolls are calculated by means of the following equation:

$$S_{bs(x)}=[(\pi D^2_{bss(x)}-D^2_{bss(x)})/4]*K_1$$

Figure 4:
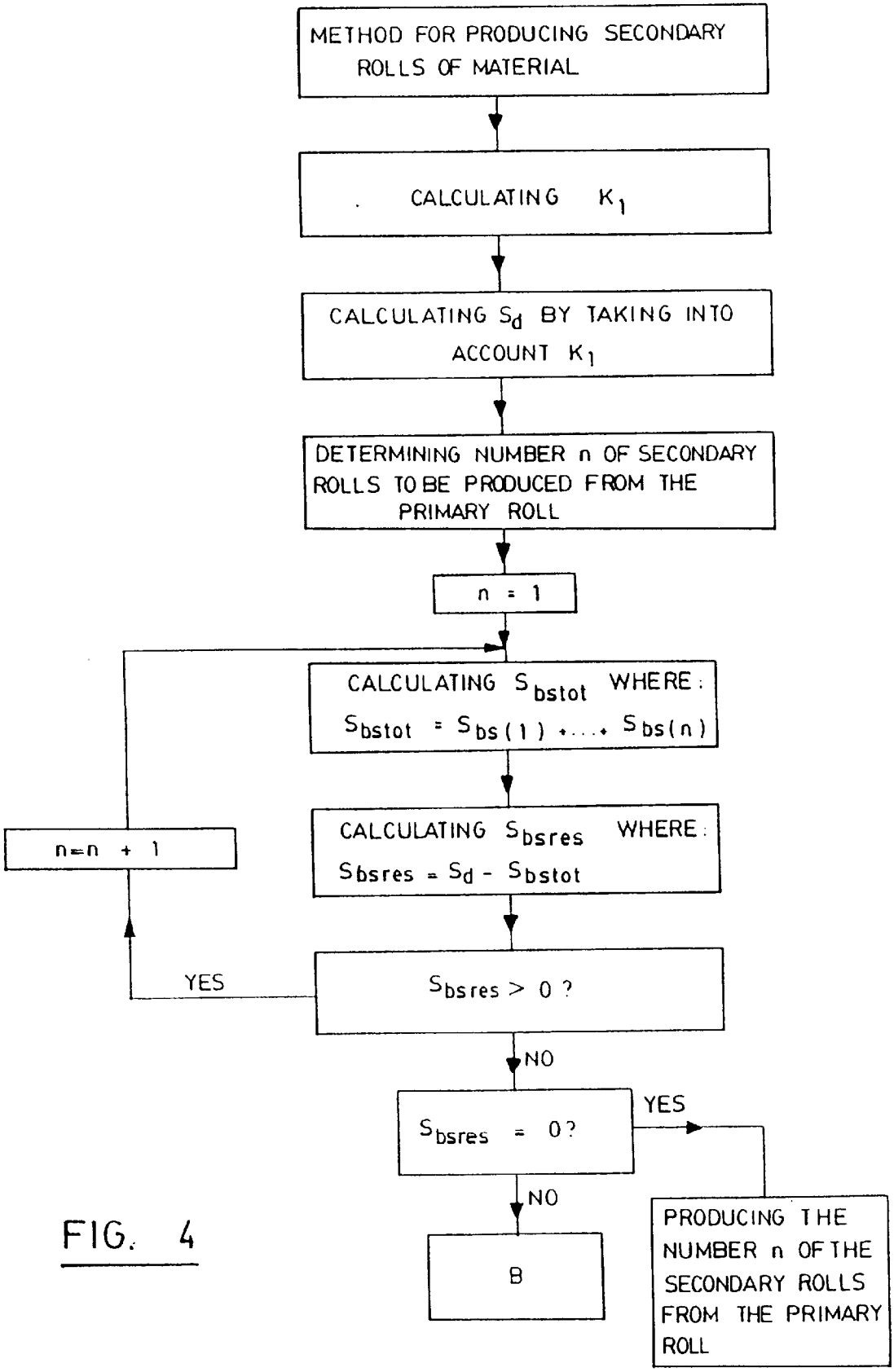
FIG. 4 is a part of a flow chart diagram illustrating a method for producing first smaller secondary rolls of material from an amount of material available on the first primary roll in accordance with the present invention.
Figure 5:
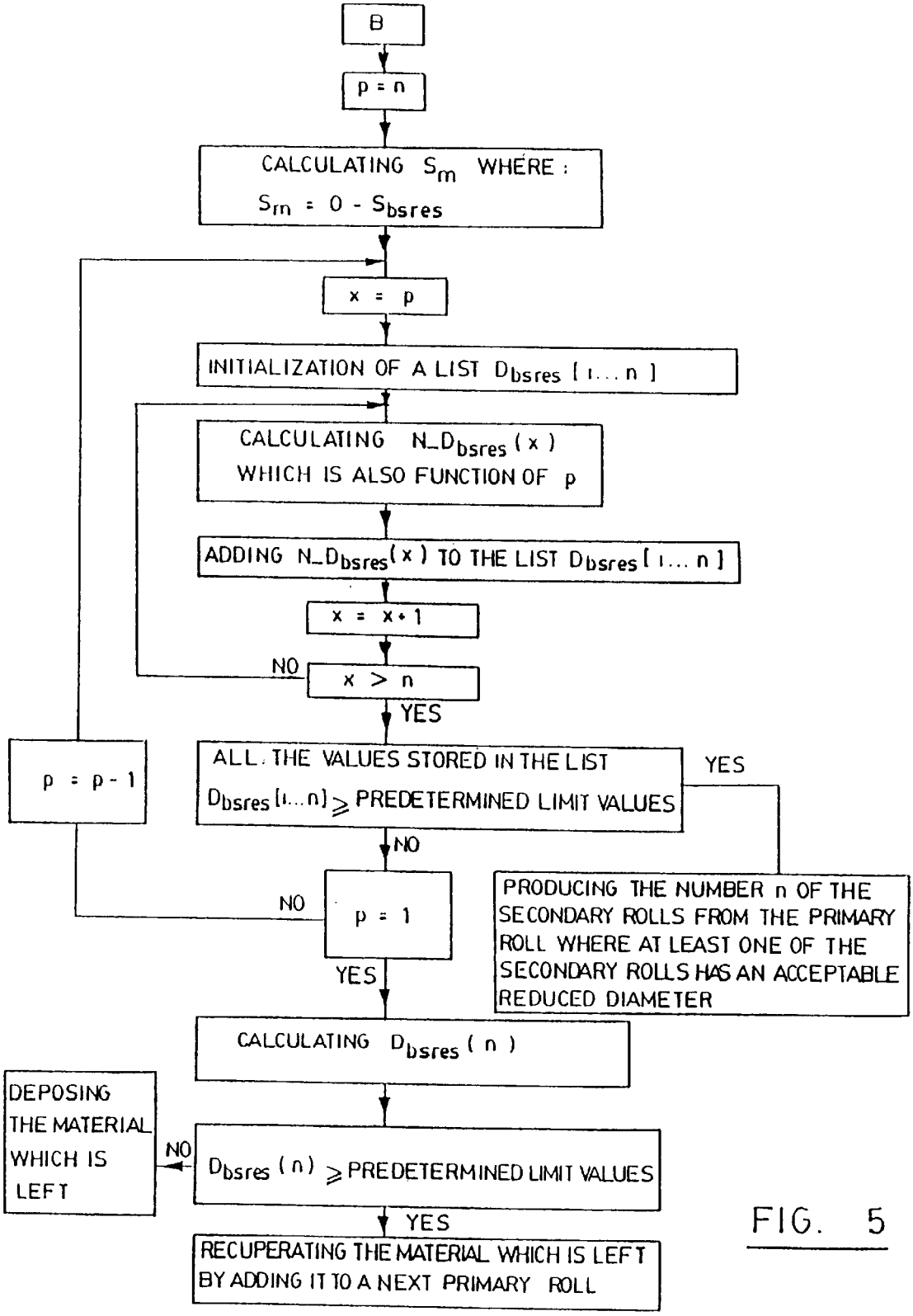
FIG. 5 is a continuation of the flow chart diagram shown in FIG. 4.

Referring now to FIGS. 4 and 5, there are shown in more detail all the steps of the method for producing smaller secondary rolls of material with given diameter values from the amount of material available on the first primary roll according to the first embodiment.

As shown, the method according to the first embodiment comprises steps of calculating $K_1$; calculating the value $S_d$ as a function of $[(X-S_p)/K_1]$, where $S_p$ is representative of an unusable amount of material on the first primary roll and the value X is determined by means of diameter values $D_f$ and $D_{sf}$ as mentioned hereinbefore; and determining a number n of secondary rolls to be produced from the primary roll, each of the secondary rolls having a given diameter value.

Also, the method comprises the steps of calculating $S_{bstot}$ and calculating a value $S_{bsres}$ which is equal to $(S_d-S_{bstot})$ and represents the amount of paper which is left, if there is any left, after producing the secondary rolls, the value $S_{bstot}$ being representative of the amount of material needed to produce smaller secondary rolls.

The method also comprises a step of calculating a value $S_m$ which is representative of the amount of material which is needed in order to produce the last secondary roll of material with the given diameter value if the value $S_{bsres}$ is smaller than 0, meaning there is not enough of available material on the primary roll for producing all of the secondary rolls with given diameter values. As shown, the value $S_m$ is equal to $0-S_{bsres}$.

As shown in FIG. 5, the method further comprises steps of initializing a list $D_{bsres}[1\ldots n]$; calculating reduce diameter values $N_D_{bsres}(x)$ of each of the secondary rolls which are numbered by x with the following equation:

$$N_D_{bsres}(x)=\sqrt{\frac{4*(S_{bs(x)})}{\pi}+D^2_{bss(x)}-\frac{4*(S_m)}{\pi(n-p+1)}}$$

The method also comprises steps of adding each value $N_D_{bsres}$ to the aforesaid list $D_{bsres}[1\ldots n]$ and verifying whether each of the stored values in the list $D_{bsres}[1\ldots n]$ are greater than or equal to predetermined limit values. As shown, if the result of the test of verifying is positive, meaning the calculated reduced diameter values of one or more of the secondary rolls are acceptable and thus the secondary rolls can be produced with these reduced diameter values from the material available on the primary roll, the method comprises the step of producing the number n of these secondary rolls where one or more have the reduced diameter value. If the result of the test of verifying is negative, and that for all of the values stored in the list $D_{bsres}[1\ldots n]$, calculating the value $D_{bsres}(n)$, which is a value representing the amount of material left on the primary roll after producing only the ones of the smaller secondary rolls which can be completely produced with the given diameter values. This value $D_{bsres}(n)$ is calculated with the following equation:

$$D_{bsres}(n)=\sqrt{\frac{4*S_{bs(n)}}{\pi}+D^2_{bss(n)}-\frac{4*S_m}{\pi}}$$

After the value $D_{bsres}(n)$ has been calculated, it is compared to a predetermined limit value and if the value $D_{bsres}(n)$ is greater than or equal to the predetermined limit value, only then the amount of material which is left can be recuperated, or else the material which is left has to be disposed.

Figure 6:
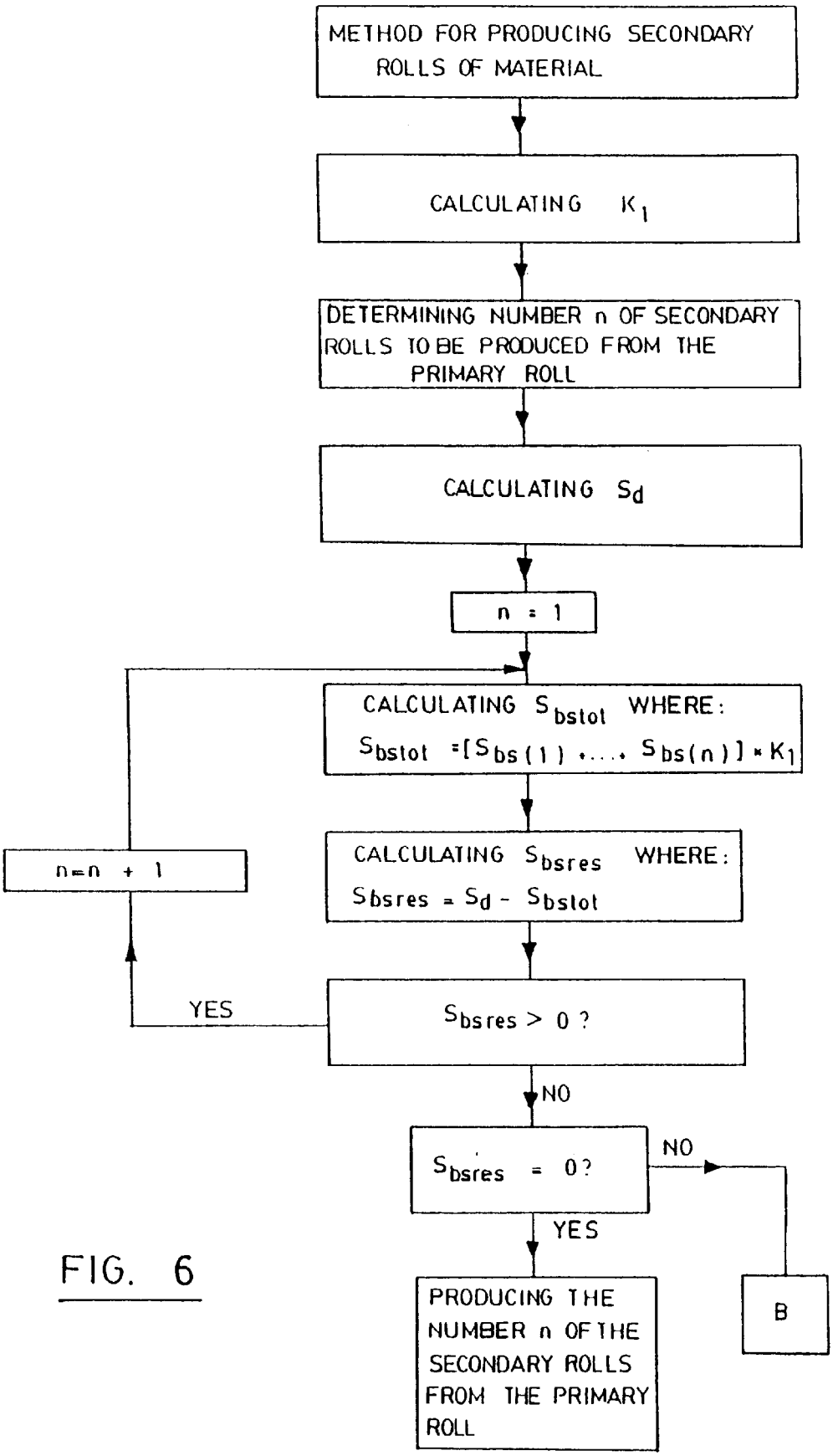
FIG. 6 is a part of a flow chart diagram illustrating another method for producing first smaller secondary rolls of material from an amount of material available on the first primary roll in accordance with the present invention.
Figure 7:
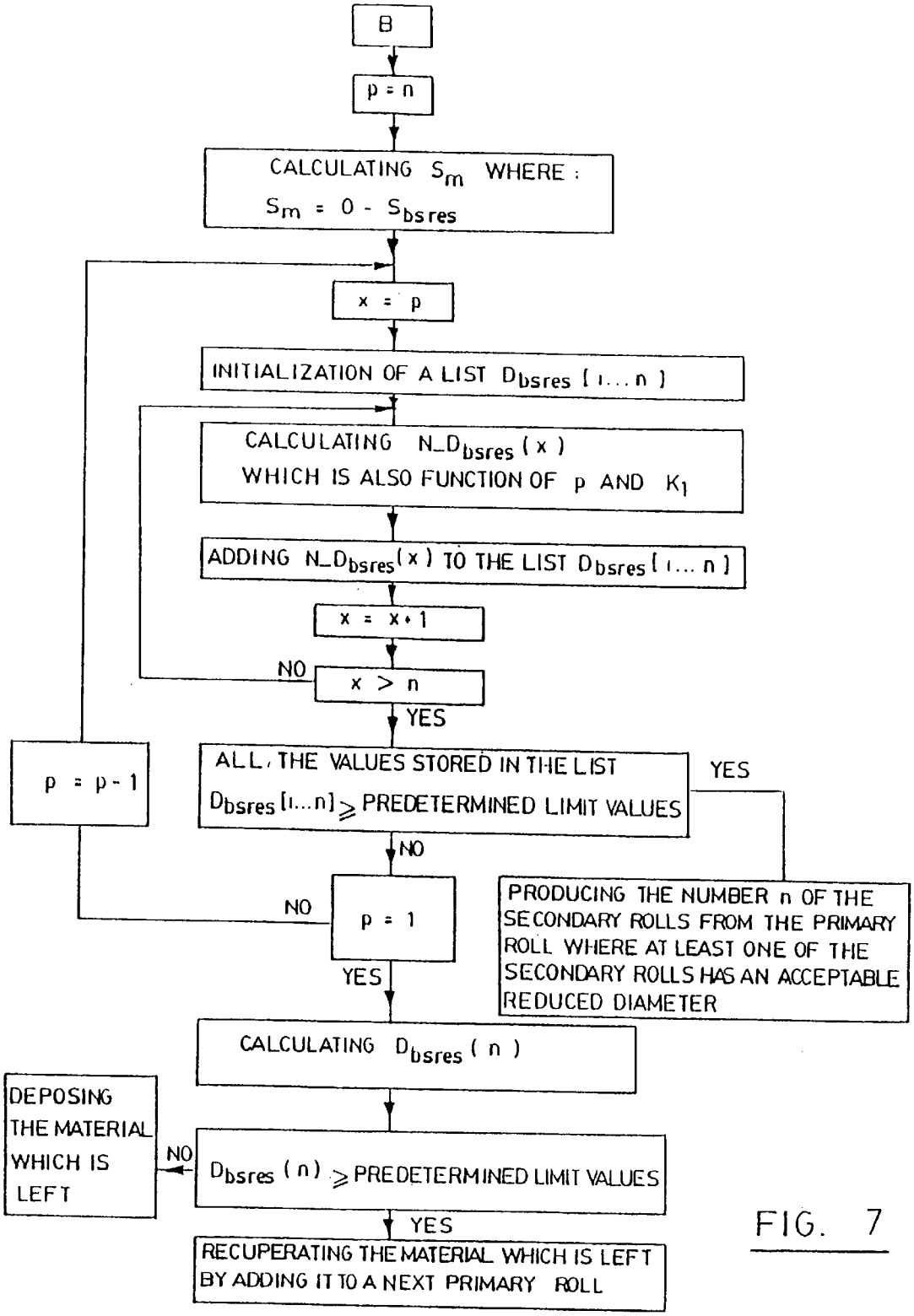
FIG. 7 is a continuation of the flow chart diagram shown in FIG. 6.

Referring to FIGS. 6 and 7, there are shown in more detail all the steps of a method according to an alternative embodiment for producing smaller secondary rolls of material with given diameter values from the amount of material available on the first primary roll according to the second embodiment.

As shown, the method according to the alternative embodiment comprises steps of calculating $K_1$; calculating the value $S_d$ as a function of $(X-S_p)$, where $S_p$ is representative of an unusable amount of material on the first primary roll and the value X is determined by means of diameter values $D_f$ and $D_{sf}$ as mentioned hereinbefore; and determining a number n of secondary rolls to be produced from the primary roll, each of the secondary rolls having a given diameter value. Also, the method comprises the steps of calculating $S_{bstot}$ by taking into account the compression factor $K_1$ and calculating a value $S_{bsres}$ which is equal to $(S_d-S_{bstot})$ and represents the amount of paper which is left, if there is any left, after producing the secondary rolls, the value $S_{bstot}$ being representative of the amount of material needed to produce smaller secondary rolls. The method comprises a step of calculating a value $S_m$ which is representative of the amount of material which is needed in order to produce the last secondary roll of material with the given diameter value if the value $S_{bsres}$ is smaller than 0, meaning there is not enough of available material on the primary roll for producing all of the secondary rolls with given diameter values.

As shown in FIG. 7, the method further comprises steps of initializing a list $D_{bsres}[1 \ldots n]$; calculating reduce diameter values $N_D_{bsres}(x)$ of each of the secondary rolls which are numbered by x with the following equation:

$$N_D_{bsres}(x)=\sqrt{\frac{4*\frac{(S_{bs(x)})}{K1}}{\pi}+D^2_{bss(x)}-\frac{4*\left(\frac{S_m}{K1}\right)}{\pi(n-p+1)}}$$

The method also comprises a step of adding each value $N_D_{bsres}(n)$ to the aforesaid list $D_{bsres}[1 \ldots n]$ and verifying whether each of the stored values in the list $D_{bsres}[1 \ldots n]$ are greater than or equal to predetermined limit values. If the result of the test of verifying is positive, meaning the calculated reduced diameter values of one or more of the secondary rolls are acceptable and the secondary rolls can be produced with these reduced diameter values from the material available on the primary roll, then the method further comprises the step of producing the number n of these secondary rolls where one or more have a reduced diameter value. If the result of the test of verifying is negative, and that for all of the values stored in the list $D_{bsres}[1 \ldots n]$, then the method further comprises the step of calculating the value $D_{bsres}(n)$, which is a value representing the amount of material left on the primary roll after producing only the ones of the smaller secondary rolls with the given diameter values. This value $D_{bsres}(n)$ is calculated with the following equation:

After the value $D_{bsres}(n)$ has been calculated, it is compared to a predetermined limit value and if the value $$N_D_{bsres}(n)=\sqrt{\frac{4*\frac{(S_{bs(n)})}{K1}}{\pi}+D^2_{bss(n)}-\frac{4*\left(\frac{S_m}{K1}\right)}{\pi}}$$

$D_{bsres}(n)$ is greater than or equal to the predetermined limit value, only then the amount of material which is left can be recuperated, or else the material which is left has to be disposed.

Now, in order to better understand the method for producing smaller secondary rolls of material with given diameter values from an amount of material available on a first primary roll, we will describe an example with possible parameters.

After the primary roll 9 of paper has been produced at the working station 2 with the use of the previously calculated compression factor $K_1$ of 1,0250, the operator mounts this primary roll 9 at the working station 10 for producing smaller secondary rolls of paper.

Consequently, there is the primary roll 9 to unroll according to the following parameters:

- diameter of the spindle of the primary roll $D_{sf}$: 0,450 m;
- diameter of the primary roll $D_f$: 2,198 m;
- number n of secondary rolls to be produced from the primary roll: 4;
- diameter of each of the secondary rolls to be produced from the primary roll: 1,067 m; and
- diameter of the spindle of each secondary roll $D_{bss}$: 0,100 m.

After examining the primary roll, it has been found that this primary roll is damaged and 0,060 m of thickness of the paper has to be taken out from the surface of the primary roll. After the paper has been taken out, the primary roll has a new diameter value of [2,198−(2*0,060)]=2,078 m.

The operator, by using the terminal 18, will instruct the computer 16 to evaluate the shortage of paper in the primary roll in order to complete all the desired secondary rolls (4*1,067). Firstly, the computer will calculate the actual useful lateral surface of paper X which is wound around the spindle of the primary roll of paper:

$$X=[(\pi*D^2_f)/4-(\pi*D^2_{sf})/4]$$

$$X=[(\pi*(2{,}078\ \mathrm{m})^2)/4-(\pi*(0{,}0450\ \mathrm{m})^2)/4]$$

$$X=3{,}232\ \mathrm{m}^2$$

$$S_d=(X-S_p)/K_1$$

$$S_d=(3.232\ \mathrm{m}^2-0)/1.0250$$

$$S_d=3{,}153\ \mathrm{m}^2$$

The total lateral surface of paper $S_{bstot}$ which is needed to produce four smaller secondary rolls is:

lateral surface of paper for one secondary roll:

$$S_{bs(1)}=[\pi(D^2_{bs(1)})-(D^2_{bss(1)})/4]$$

$$S_{bs(1)}=[\pi(1{,}067\ \mathrm{m})-(0{,}100\ \mathrm{m})/4]$$

$$S_{bs(1)}=0{,}886\ \mathrm{m}^2$$

$$S_{bstot}=4*0{,}886\ \mathrm{m}^2$$

$$S_{bstot}=3{,}544\ \mathrm{m}^2$$

the lateral surface $S_{bsres}$ which is needed in order to completely produce four secondary rolls of paper:

$$S_{bsres}=S_d-S_{bstot}$$

$$S_{bsres}=3.153\ m^2-3.544\ m^2$$

$$S_{bsres}=-0{,}391\ m^2$$

$$S_m=0-(-0{,}391)m^2$$

$$S_m=0{,}391\ m^2$$

The next step for the operator is to determine whether he or she can complete the secondary rolls with the paper of the primary roll in a case where the diameter values of the secondary rolls are reduced within an acceptable limit. Most of the clients allow for the secondary rolls to have smaller dimensions than the dimensions they specified. However, there is an usual standard limit of approximately 0,012 m. Therefore, the operator will instruct the terminal to apply a correction to the values of diameters of secondary rolls to lower the same in order to produce them, if possible, with the surface available on the primary roll. We will use the formula displayed in the algorithms to calculate the real diameter values of the secondary rolls to be produced therefrom. This is done in order to determine whether the secondary roll diameter values will respect the predetermined limits. We calculate the final diameter value with the following formula:

$$D_{bsres(x)}=\sqrt{\frac{4*S_{bs(x)}}{\pi}+D^2_{bss(x)}-\frac{4*S_m}{\pi(n-p+1)}}$$

For example, if we apply the compensation only on the last secondary roll to be produced, we get the following diameter value:

$$D_{bsres(x)}=\sqrt{\frac{4*0{,}886\ m^2}{\pi}+(0{,}100\ m)^2-\frac{4*0{,}391\ m^2}{\pi(4-4+1)}}$$

If we apply the compensation only on the two (2) last secondary rolls to be produced, we get the following diameter values:

$$D_{bsres}=0.943\ m.$$

If we apply the compensation only on the three (3) last secondary rolls to be produced, we get the following diameter values:

$$D_{bsres}=0.986\ m.$$

If we apply the compensation only on the four (4) last secondary rolls to be produced, we get the following diameter values:

$$D_{bsres}=1{,}007\ m.$$

As you can see, none of those diameter values is higher or equal to the predetermined acceptable value of 1,055 m (1,067 m−0,012 m).

The next step is to produce all the secondary rolls with the predetermined diameter values of 1,067 m, except for the last one which will have a smaller diameter value. Because of the present system, the operator can determine in advance the amount of paper which he or she will have to add by gluing to the next primary roll of paper to complete the last secondary roll. By looking at the first calculation we did to evaluate the final diameter when the compensation is applied only to the last secondary roll, we see that we have for the last incomplete secondary roll a diameter value of 0,800 m. Therefore, the operator has to instruct the computer to add an amount of paper necessary to complete the last incomplete secondary roll of paper to next primary roll, so that the diameter of the last incomplete secondary roll passes from 0,800 m to 1,067 m.

Although the invention has been described above in detail in the framework of a preferred embodiment, it should be understood that the scope of the present invention is to be determined by the appended claims.

The embodiments of the invention in which an exclusive property or privilege is claimed are defined as follows:

1. Method for determining an amount of material available on a primary roll for producing smaller secondary rolls, said primary roll being previously produced by a given manufacturing process, having a diameter value $D_f$ and comprising a spindle having a diameter value $D_{sf}$, said method comprising the steps of:

determining a value X which is representative of an amount of material wound around the spindle of said primary roll by means of said diameter values $D_f$ and $D_{sf}$ where $X=((\pi*D_f^2)/4)-(\pi*D_{sf}^2)/4))$;

calculating a compression factor K1 where K1=((the lateral surface area of material forming a previous primary roll)/(the lateral surface area of material forming previous smaller secondary rolls produced with the previous primary roll)), said previous primary roll being previously produced by said manufacturing process; and determining said amount of material as being equal to $((X-S_p)/K1)$ where $S_p$ is representative of an unusable amount of material on the primary roll.

2. Method according to claim 1, for producing smaller secondary rolls of material with given diameter values from said amount of material available on said primary roll, said method further comprising the steps of:

calculating a value $S_{bstot}$ which is representative of an amount of material needed to produce said smaller secondary rolls, the value $S_{bstot}$ being calculated by means of the following equation:

$$S_{bstot}4t\ S_{bs(1)}+\ .\ .\ .\ +S_{bs(n)}$$

where $S_{bs(1)}+\ .\ .\ .\ +S_{bs(n)}$ is a sum of lateral surfaces of material of said smaller secondary rolls which are n in number, each of the lateral surfaces of the smaller secondary rolls being calculated $$S_{bs(x)}=(\pi(D_{bs(x)}{}^2-D_{bss(x)}{}^2)/4)*K1$$

by means of the following equation:

where $D_{bs(x)}$ is a diameter value of the corresponding smaller secondary roll which is numbered by x and $D_{bss(x)}$ is a diameter value of the spindle thereof; and verifying whether said amount of material available on said primary roll is sufficient to produce said smaller secondary rolls by comparing said amount of material available on the primary roll to said value $S_{bstot}$, and either producing said secondary rolls if said amount of material available on the primary roll is sufficient, or else going to a step of verifying whether said amount of material available on said primary roll is sufficient to produce said smaller secondary rolls where at least one of said smaller secondary rolls has a reduced diameter which is no less than a predetermined acceptable reduced diameter value, and either producing said smaller secondary rolls wherein at least one of said smaller secondary rolls has said reduced diameter value if said amount of material available on the primary roll is sufficient, or else producing only the ones of the smaller secondary rolls which can be completely produced with said given diameter values from said amount of material available on said primary roll.

3. Method according to claim 2, characterized in that it further comprises after the step of verifying whether the amount of material (4) available on the primary roll (8) is sufficient to produce the smaller secondary rolls (12), the step of comparing a value $D_{bsres}$ which is representative of an amount of material (4) which is left after producing said ones of the smaller secondary rolls (12) with said given diameter values to a predetermined limit value, and either disposing said amount of material (4) which is left if said value $D_{bsres}$ is smaller than said predetermined limit value, or recuperating said amount of material (4) which is left by adding said amount of material (4) which is left to a next primary roll (8).

4. Method according to claim 2, wherein in the step of calculating the value $S_{bstot}$, said value $S_{bstot}$ is calculated by means of the following equation:

$$S_{bstot}=S_{bs(1)}+\ldots+S_{bs(n)}$$

where $S_{bs(1)}+\ldots+S_{bs(n)}$ is a sum of lateral surfaces of material of said smaller secondary rolls which are n in number, each of said lateral surfaces of said smaller secondary rolls are calculated by means of the following equation:

$$[S_{bs(x)}=(B(D^2_{bs(x)}-D^2_{bss(x)})/4)*K1]S_{bs(x)}=(\pi(D^2_{bs(x)}-D^2_{bss(x)})/4*K1$$

where $D_{bs(x)}$ is a diameter value of the corresponding smaller secondary roll which is numbered by x and $D_{bss(x)}$ is a diameter value of a second spindle thereof.

5. Method according to claim 1, in said calculating step, said compression factor K1=((a lateral surface of material of said previous primary roll used to produce said previous smaller secondary rolls)/(sum of lateral surfaces of material of said previous smaller secondary rolls)).

6. Method according to claim 1, wherein in the step of determining the value X, said value X is determined by means of the following equation:

$$[X=((B*D_f^2)/4)-(B*D_{sf}^2)/4).]X=((\pi*D_f^2)/4-(\pi*D_{sf}^2)/4).$$

7. Apparatus for producing smaller secondary rolls of material with given diameter values from an amount of material available on a primary roll, said primary roll being previously produced by a given manufacturing process, having a diameter value $D_f$ and comprising a spindle having a diameter value $D_{sf}$, said apparatus comprising:

means for determining a value X which is representative of an amount of material wound around the spindle of said primary roll by means of said diameter values $D_f$ and $D_{sf}$ where $X=((\pi*D_f^2)/4)-(\pi*D_{sf}^2)/4))$;

means for calculating a value $S_{bstot}$ which is representative of an amount of material which is needed to produce said smaller secondary rolls, the value $S_{bstot}$ being calculated by means of the following equation:

$$S_{bstot}=S_{bs(1)}+\ldots+S_{bs(n)}$$

where $S_{bs(1)}+\ldots+S_{bs(n)}$ is a sum of lateral surfaces of material of said smaller secondary rolls which are n in number, each of the lateral surfaces of the smaller secondary rolls being calculated $$S_{bs(x)}=(\pi(D_{bs(x)}^2-D_{bss(x)}^2)/4)*K1$$

by means of the following equation:

where $D_{bs(x)}$ is a diameter value of the corresponding smaller secondary roll which is numbered by x and $D_{bss(x)}$ is a diameter value of the spindle thereof;

means for calculating a compression factor K1 where K1=((the lateral surface area of material forming a previous primary roll)/(the lateral surface area of material forming previous smaller secondary rolls produced with the previous primary roll)), said previous primary roll being previously produced by said manufacturing process;

means for determining said amount of material as being equal to $(X-S_p)/K1$ where $S_p$ is representative of an unusable amount of material on said primary roll;

first means for verifying whether said amount of material available on said primary roll is sufficient to produce said smaller secondary rolls by comparing said amount of material available on the primary roll to said value $S_{bstot}$;

means for producing said smaller secondary rolls if said amount material available on the primary roll as verified by the first means for verifying is sufficient;

second means for verifying whether said amount of material available on said primary roll is sufficient to produce said smaller secondary rolls where at least one of said smaller secondary rolls has a reduced diameter value which is no less than a predetermined acceptable reduced diameter value;

means for producing said smaller secondary rolls wherein at least one of said smaller secondary rolls has said reduced diameter value if said amount of material available on the primary roll as verified by the second means for verifying is sufficient; and means for producing only the ones of the smaller secondary rolls which can be completely produced with said given diameter values from said amount of material available on said primary roll if said amount of material available on the primary roll as verified by the second means for verifying is not sufficient.

8. Method for producing smaller secondary rolls of material with given diameter values from an amount of material available on a primary roll, said primary roll being previously produced by a given manufacturing process, having a diameter value $D_f$ and comprising a spindle having a diameter value $D_{sf}$, said method comprising steps of:

determining a value X which is representative of an amount of material wound around the spindle of said primary roll by means of said diameter values $D_f$ and $D_{sf}$ where $X=((\pi*D_f^2)/4)-(\pi*D_{sf}^2)/4))$;

calculating a value $S_{bstot}$ which is representative of an amount of material which is needed to produce said smaller secondary rolls, the value $S_{bstot}$ being calculated by means of the following equation:

$$S_{bstot}=S_{bs(1)}+\ldots+S_{bs(n)}$$

where $S_{bs(1)}+\ldots+S_{bs(n)}$ is a sum of lateral surfaces of material of said smaller secondary rolls which are n in number, each of the lateral surfaces of the smaller secondary rolls being calculated by means of the following equation:

$$S_{bs(x)}=(\pi(D_{bs(x)}^2-D_{bss(x)}^2)/4)*K1$$

where $D_{bs(x)}$ is a diameter value of the corresponding smaller secondary roll which is numbered by x and $D_{bss(x)}$ is a diameter value of the spindle thereof;

calculating a compression factor K1 where K1=((the lateral surface area of material forming a previous primary rolls)/(the lateral surface area of material forming previous smaller secondary rolls produced with the previous primary roll)), said previous primary roll being previously produced by said manufacturing process;

determining said amount of material as being equal to $((X-S_p))/K1$ where $S_p$ is representative of an unusable amount of material on the primary roll;

verifying whether said amount of material available on said primary roll is sufficient to produce said smaller secondary rolls by comparing said amount of material available on the primary roll to said value $S_{bstot}$, and either producing said secondary rolls if said amount of material available on the primary roll is sufficient, or else going to a step of verifying whether said amount of material available on said primary roll is sufficient to produce said smaller secondary rolls where at least one of said smaller secondary rolls has a reduced diameter value which is no less than a predetermined acceptable reduced diameter value, and either producing said smaller secondary rolls wherein at least one of said smaller secondary rolls has said reduced diameter value if said amount of material available on the primary roll is sufficient, or else producing only the ones of the smaller secondary rolls which can be completely produced with said given diameter values from said amount of material available on said primary roll.

9. Method for producing a primary roll having a predetermined lateral surface defined by a diameter $D_f$, said primary roll being made of material wound around a spindle according to a given manufacturing process, said material being used to produce smaller secondary roll of material, said method comprising steps of:

calculating a compression factor K1 where K1=((the lateral surface area of material forming a previous primary roll)/(the lateral surface area of material forming previous secondary rolls produced with the previous primary roll)), said previous primary roll being previously produced by said manufacturing process;

calculating $D_f$ where:

$$D_f=\sqrt{(4(S_{f+(S_{i}K1)}))/\pi};$$

where $S_f$ is a lateral surface area covered by the spindle and $S_i$ is lateral surface area of the material needed to produce the smaller secondary rolls of material; and calculating a length of material $L_{BP}$ which is necessary to produce said primary roll having said diameter value $D_f$, said length of material $L_{BP}$ being calculated by means of the $$L_{BP}=(\pi*(D_f^2-D_{sf}^2)/(4*E_{BP}))$$

following equation:

where $D_{SF}$ is a diameter value of said spindle, and $E_{BP}$ is an estimated thickness value of said material; and winding up the length of material $L_{BP}$ around the spindle to produce the primary roll.

10. Apparatus for determining an amount of material available on a primary roll for producing smaller secondary rolls, said primary roll being previously produced by a given manufacturing process, having a diameter value $D_f$ and comprising a spindle having a diameter value $D_{sf}$, said apparatus comprising:

means for determining a value X which is representative of amount of material wound around the spindle of said primary roll by means of said diameter values $D_f$ and $D_{sf}$ where $X=((\pi*D^2_f)/4)-(\pi*D_{sf}^2)/4))$;

means for calculating a compression factor K1 where K1=((the lateral surface area of material forming a previous primary roll)/(the lateral surface area of material forming previous smaller secondary rolls produced with the previous primary roll)), said previous primary roll being previously produced by said manufacturing process; and means for determining said amount of material available on the primary roll as being equal to $((X-S_p)/K1)$, where $S_p$ is representative of an unusable amount of material on said primary roll.

11. Apparatus according to claim 10, for producing smaller secondary rolls of material with given diameter values from said amount of material available on said primary roll, the apparatus further comprising:

means for calculating a value $S_{bstot}$ which is representative of amount of material needed to produce said smaller secondary rolls, the value $S_{bstot}$ being calculated by means of the following equation:

$$S_{bstot}=S_{bs(1)}+\ldots+S_{bs(n)}$$

where $S_{bs(1)}+\ldots+S_{bs(n)}$ is a sum of lateral surfaces of material of said smaller secondary rolls which are n in number, each of the lateral surfaces of the smaller secondary rolls being calculated $$S_{bs(x)}=(\pi(D_{bs(x)}^2-D_{bss(x)}^2)/4)*K1$$

by means of the following equation:

where $D_{bs(x)}$ is a diameter value of the corresponding smaller secondary roll which is numbered by x and $D_{bss(x)}$ is a diameter value of the spindle thereof;

first means for verifying whether said amount of material available on said primary roll is sufficient to produce said smaller secondary rolls by comparing said amount of material available on the primary roll to said value $S_{bstot}$;

means for producing said smaller secondary rolls if said amount of material available on the primary roll as verified by the first means for verifying is sufficient;

second means for verifying whether said amount of material available on said primary roll is sufficient to produce said smaller secondary rolls where at least one of said smaller secondary rolls has a reduced diameter which is no less than a predetermined acceptable reduced diameter value;

means for producing said smaller secondary rolls wherein at least one of said smaller secondary rolls has said reduced diameter value if said amount of material available on the primary roll as verified by the second means for verifying is sufficient; and means for producing only the ones of the smaller secondary rolls which can be completely produced with said given diameter values from said amount of material available on said primary roll if said amount of material available on the primary roll as verified by the second means for verifying is not sufficient.

12. Apparatus according to claim 11, characterized in that it further comprises means for comparing a value $D_{bsres}$ which is representative of an amount of material (4) which is left after producing said ones of the smaller secondary rolls (12) with said given diameter values to a predetermined limit value to determine whether said material (4) which is left can be recuperated.

13. Apparatus according to claim 12, characterized in that said means for comparing is a part of a computer provided with an operating software.

14. Apparatus according to claim 11 wherein said means for calculating said value $S_{bstot}$ use the following equation:

$$S_{bstot}=S_{bs(1)}+\ldots+S_{bs(n)}$$

where $S_{bs(1)}+\ldots+S_{bs(n)}$ is a sum of lateral surfaces of material of said smaller secondary rolls which are n in number; and said means for calculating said value $S_{bstot}$ comprise means for calculating each of said lateral surfaces of said smaller secondary rolls with the following equation:

$$[S_{bs(x)}=(B(D_{bs(x)}^2-D_{bss(x)}^2)/4)*K1]S_{bs(x)}=(\pi(D_{bs(x)}^2-D_{bss(x)}^2)/4)*K1$$

where $D_{bs(x)}$ is a diameter value of the corresponding smaller secondary roll which is numbered by x and $D_{bss(x)}$ is a diameter value of a second spindle thereof.

15. Apparatus according to claim 10, said compression factor K1=((sum of lateral surfaces of material of said previous primary roll used to produce said previous smaller secondary rolls)/(sum of lateral surfaces of material of said previous smaller secondary rolls)).

16. Apparatus according to claim 10, wherein said means for determining said value X comprise means for calculating said value X with the following equation:

$$[X=((B*D_f^2)/4-(B*D_{sf}^2)/4).]\ X=((\pi*D_f^2)/4-(\pi*D_{sf}^2)/4).$$

17. Apparatus according to claim 10, said means for calculating said compression factor K1, said means for determining said value X and said means for determining said amount of material available on the primary roll are all parts of a computer provided with an operating software.

18. Apparatus according to claim 17, further comprising means for comparing a value $D_{bsres}$ which is representative of an amount of material which is left after producing said ones of the first smaller secondary rolls with said given diameter values to a predetermined limit value to determine whether said material which is left can be recuperated.

* * * * *